US008132648B2

(12) United States Patent
Tong

(10) Patent No.: US 8,132,648 B2
(45) Date of Patent: Mar. 13, 2012

(54) ADJUSTABLE TREE STAND

(76) Inventor: Pai Tong, Kaohsiung (TW)

( * ) Notice: Subject to any disclaimer, the term of this patent is extended or adjusted under 35 U.S.C. 154(b) by 91 days.

(21) Appl. No.: 12/769,363

(22) Filed: Apr. 28, 2010

(65) Prior Publication Data

US 2011/0192680 A1 Aug. 11, 2011

(30) Foreign Application Priority Data

Feb. 10, 2010 (TW) ..... 99202804 U

(51) Int. Cl.
*A01M 31/00* (2006.01)

(52) U.S. Cl. ..... 182/136; 182/187

(58) Field of Classification Search ..... 182/135, 182/136, 187
See application file for complete search history.

(56) References Cited

U.S. PATENT DOCUMENTS 1,378,702 A * 5/1921 McDonald ..... 254/236
6,779,616 B1 * 8/2004 Brown ..... 180/13
7,287,623 B2 * 10/2007 Graham, Sr. ..... 182/133

* cited by examiner

*Primary Examiner* — Alvin Chin Shue
(74) *Attorney, Agent, or Firm* — Fitzpatrick, Cella, Harper & Scinto

(57) ABSTRACT

An adjustable tree stand includes a support unit that includes a support platform having two lateral parts, and that further includes first and second mounting structures, each mounted to a corresponding one of the lateral parts of the support platform. The adjustable tree stand further includes a cable unit that includes a cable, a first attachment member connected to one end of the cable, and a second attachment member connected to the other end of the cable for releasably coupling with the second mounting structure.
The adjustable tree stand also includes a control unit including a threaded rod mounted non-rotatably to the first mounting structure, and a slide seat connected to the first attachment member of the cable unit and coupled movably to the first mounting structure for sliding movement therealong.

6 Claims, 6 Drawing Sheets

ADJUSTABLE TREE STAND

CROSS REFERENCE TO RELATED APPLICATION

This application claims priority to Taiwanese application no. 099202804 filed on Feb. 10, 2010, which is herein incorporated by reference.

BACKGROUND OF THE INVENTION

1. Field of the Invention

The invention relates to a tree stand, more particularly to an adjustable tree stand that adjusts tension of a cable by moving an operable part.

2. Description of the Related Art

Referring to FIGS. 1A, 1B, 2 and 3, and to U.S. Pat. No. 7,287,623, a conventional tree stand may be attached to a tree by a cable 12. In FIGS. 1A and 1B, tree stands 1 and 1' differ primarily in whether they provide support for standing or sitting. Accordingly, tree stands 1 and 1' are not separately discussed below. The conventional tree stand 1 includes a rotatable threaded rod 132, which is used to tighten the cable 12 around a tree.

The conventional tree stand 1 may have a high defect rate. The rotatable threaded rod 132 of the conventional tree stand 1 may require precise disposition and alignment, which may require supporting structures and mounting elements to be correspondingly precisely disposed and aligned. These requirements may increase manufacturing complexity, labor costs, and a potential defect rate due to misaligned or improperly disposed components.

The conventional tree stand 1 may include a risk of structural failure. A driving component of the conventional tree stand 1 may block movement of the rotatable threaded rod 132. Damage or misassemble of the driving component of the conventional tree stand 1 may therefore allow the rotatable threaded rod 132 to be released, causing the conventional tree stand 1 to fail while supporting a user.

The conventional tree stand 1 may include a risk of loss of components. The driving components of the conventional tree stand 1 may be removed and misplaced during transportation or between uses of the tree stand 1.

SUMMARY OF THE INVENTION

An object of the present invention is to provide an adjustable tree stand that facilitates manufacturing.

Another object of the present invention is to provide a highly safe adjustable tree stand.

Yet another object of the present invention is to provide an adjustable tree stand with parts that are less likely to be lost.

Accordingly, an adjustable tree stand of this invention comprises a support unit that includes a support platform having two lateral parts, and that further includes first and second mounting structures, each mounted to a corresponding one of the lateral parts of the support platform. The adjustable tree stand further includes a cable unit that includes a cable, a first attachment member connected to one end of the cable, and a second attachment member connected to the other end of the cable for releasably coupling with the second mounting structure.

The adjustable tree stand also includes a control unit including a threaded rod mounted non-rotatably to the first mounting structure, and a slide seat connected to the first attachment member of the cable unit and coupled movably to the first mounting structure for sliding movement therealong.

The control unit also includes a gear set mounted rotatably to the slide seat and threadedly engaging the threaded rod, and a drive part for driving rotation of the gear set to thereby cause the slide seat to move along the first mounting structure for adjusting a tension of the cable unit.

The invention therefore provides an adjustable tree stand with a fixed threaded rod that facilitates manufacturing and enhances safety.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1A:
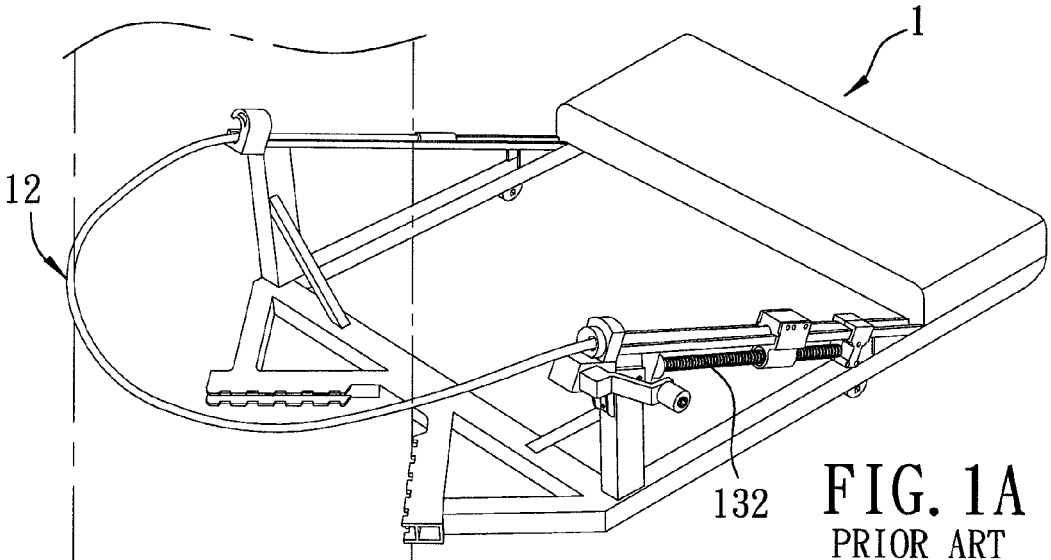
FIG. 1A PRIOR ART
FIGS. 1A and 1B are perspective views of conventional adjustable tree stands.
Figure 1B:
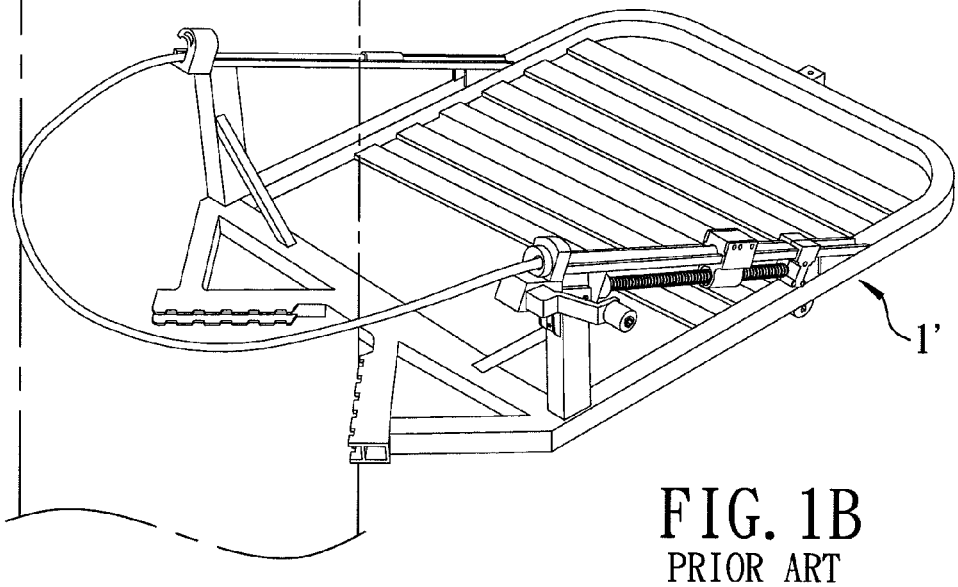
FIG. 1B PRIOR ART
Figure 2:
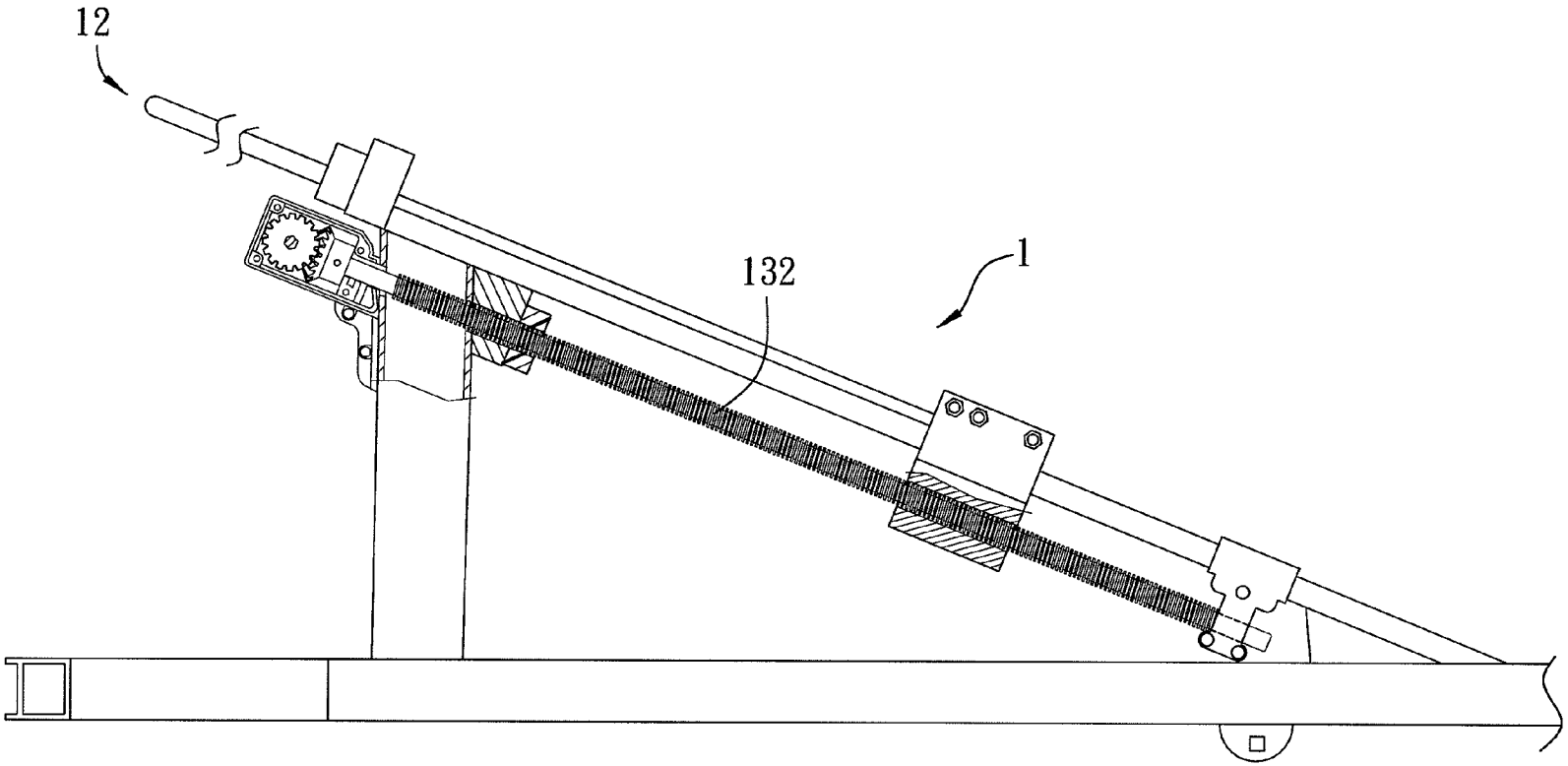
FIG. 2 PRIOR ART
FIG. 2 is a fragmentary schematic sectional view of the conventional adjustable tree stand in FIG. 1A.
Figure 3:
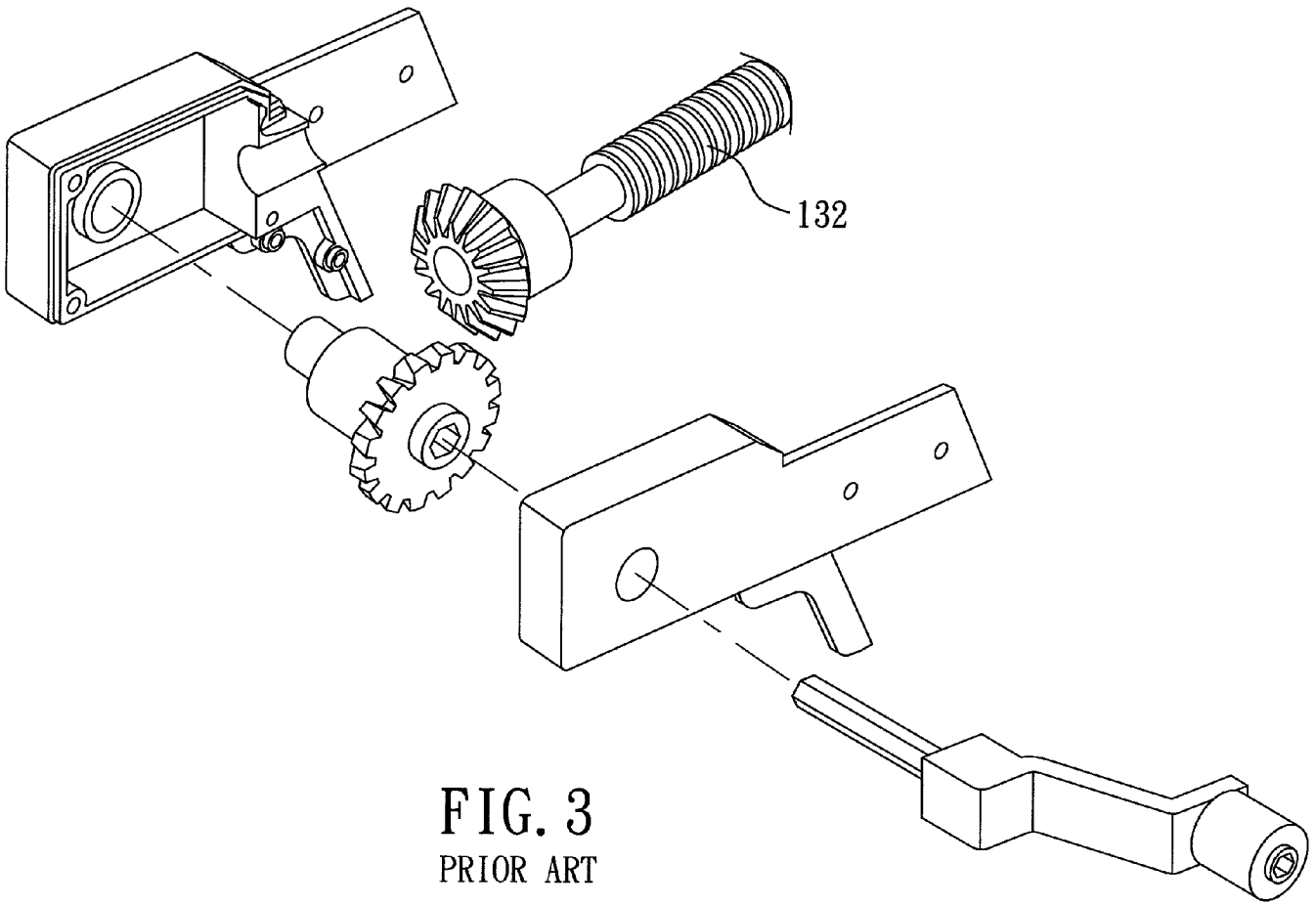
FIG. 3 PRIOR ART
FIG. 3 is a partly exploded perspective view of the conventional adjustable tree stand in FIG. 1A.
Figure 4:
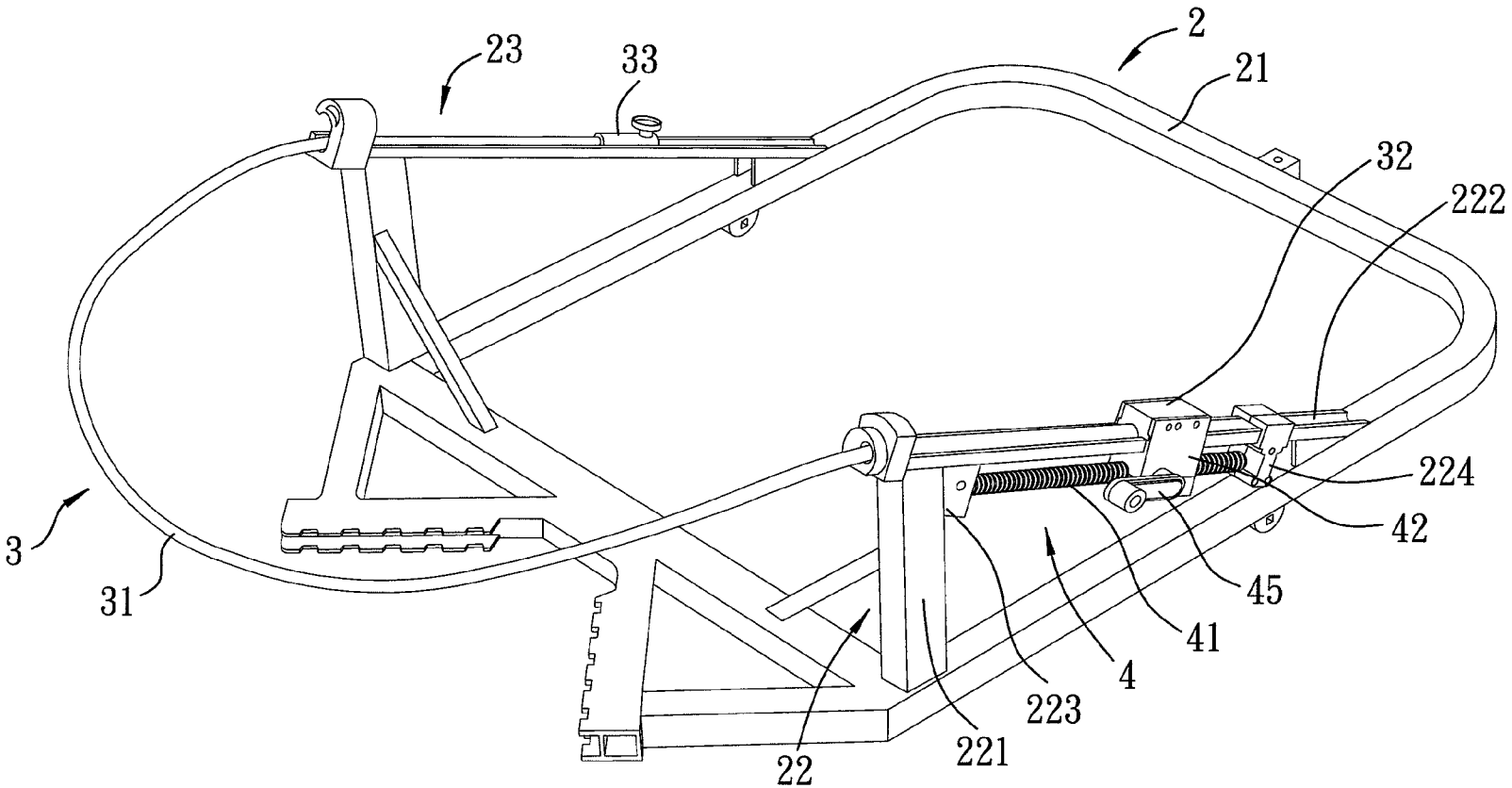
FIG. 4 is a perspective view of the preferred embodiment of an adjustable tree stand according to the present invention.
Figure 5:
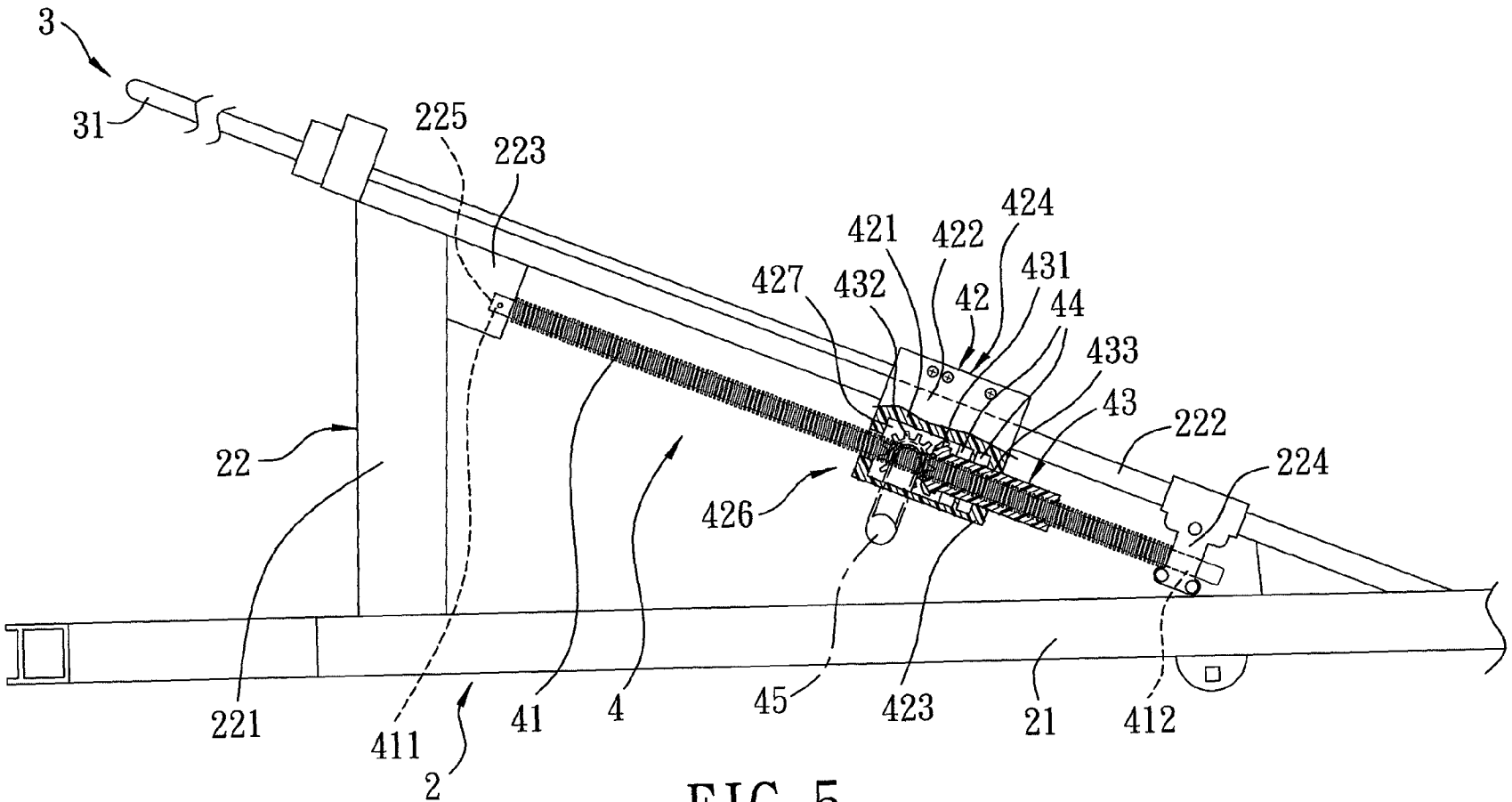
FIG. 5 is a fragmentary schematic sectional view of the preferred embodiment.
Figure 6:
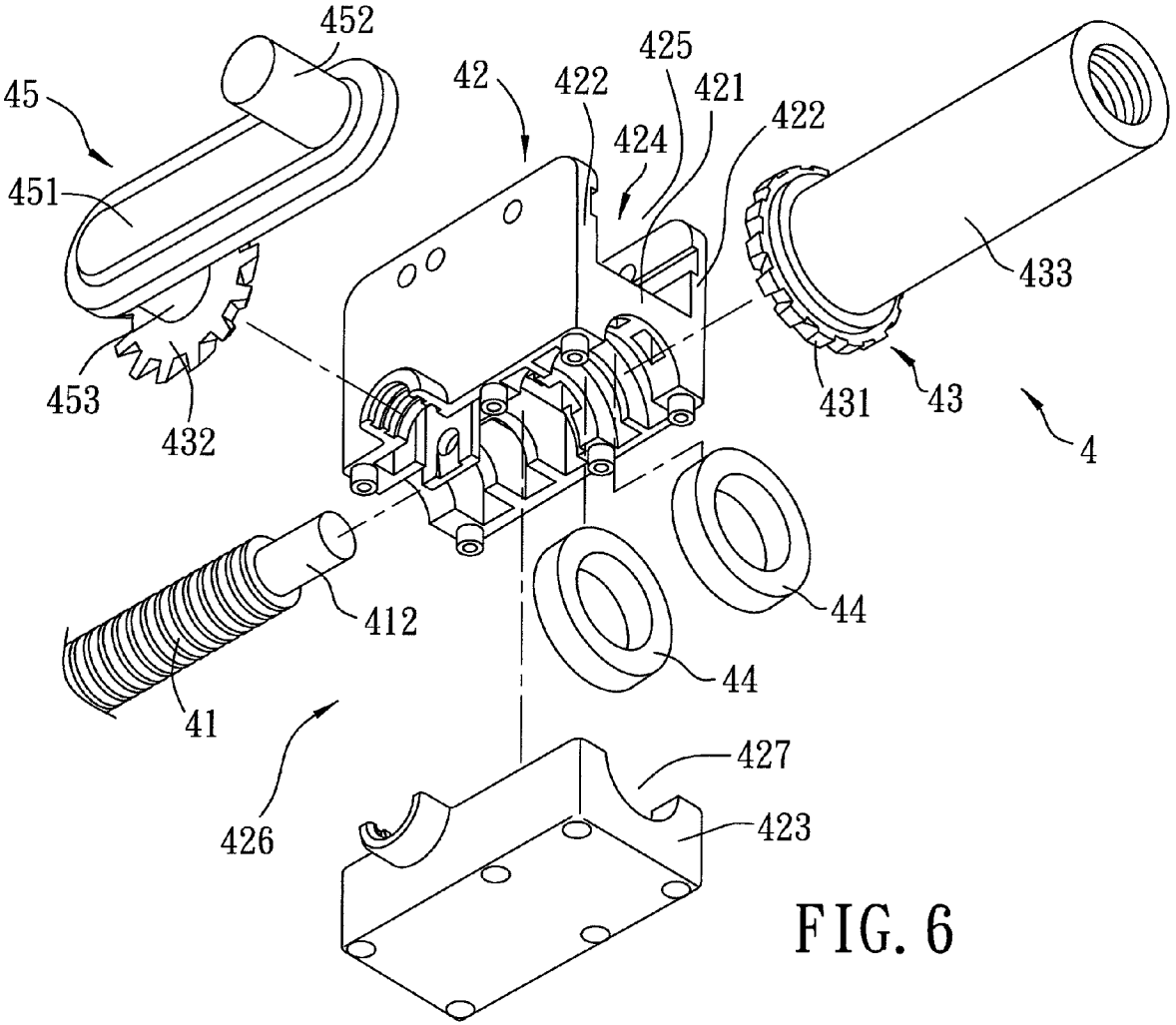
FIG. 6 is an exploded fragmentary perspective view of the preferred embodiment.

Referring to FIGS. 4, 5 and 6, a pair of adjustable tree stands according to the preferred embodiment of the present invention may be hung from a tree and vertically separated. The adjustable tree stand includes a support unit 2, a cable unit 3 and a control unit 4.

The support unit 2 includes a support platform 21 adapted for providing support for standing or sitting, and a first mounting structure 22 and a second mounting structure 23 mounted on opposite lateral sides (e.g., lateral parts) of the support platform 21, respectively. The first mounting structure 22 includes a strut 221 that extends upward from a forward section of a corresponding one of the lateral parts, and a guide 222 that extends rearward and inclines downward from a top part of the strut 221. The first mounting structure 22 further includes a front block 223 mounted to the strut 221 and formed with a blind hole 225 that opens rearward, and a rear block 224 fixed to a rearward part of the guide 222.

The cable unit 3 includes a flexible cable 31 disposed at a front of the support unit 2, a first attachment member 32 connected to one end of the cable 31 and disposed adjacent to the first mounting structure 22, and a second attachment member 33 connected to the other end of the cable 31 and removably engaged with the second mounting structure 23. The first attachment member 32 and the second attachment member 33 may be formed on the cable 31. Given that the primary features of this invention do not reside in the engagement mechanism between the second attachment member 33 and the second mounting structure 23, those components are not further described.

The control unit 4 includes a fixed threaded rod 41 mounted non-rotatably (e.g., fixed) to and extending from the first mounting structure 22. The control unit 4 further includes a slide seat 42 connected to the first attachment member 32 and coupled movably to the first mounting structure 22 for sliding movement therealong. The slide seat 42 may be coupled movably to the fixed threaded rod 41. The control unit 4 also includes a gear set 43 mounted rotatably to the slide seat 42 and threadedly engaged with the fixed threaded rod 41, a pair of bearings 44 mounted between the gear set 43 and the slide seat 42, and a drive part 45 for driving rotation of the gear set 43 to thereby cause the slide seat 42 to move along the first mounting structure 22 for adjusting a tension of the cable unit 3. The drive part 45 may be rotatably mounted on the slide seat 42.

The fixed threaded rod 41 is fixedly mounted parallel to and below the guide 222. In this embodiment, the fixed threaded rod 41 includes a front end portion 411 that is fixed in the blind hole 225 of the front block 223. The fixed threaded rod 41 further includes a rear end portion 412 that is fixed in the rear block 224. In variations of the preferred embodiment, bolts or any other fastening mechanism may be used to fix each of the front and rear end portions 411, 412. Additional fastening mechanisms are not further detailed hereinafter.

The slide seat 42 includes a base wall 421 disposed between the fixed threaded rod 41 and the guide 222, a pair of opposite lateral walls 422 extending upwardly from respective lateral edges of the base wall 421, and a retaining part 423 coupled to a bottom side of the base wall 421. The retaining part 423 cooperates with the base wall 421 and the lateral walls 422 to form a containing section 426.

The lateral walls 422 and the base wall 421 disposed between the lateral walls 422 form a slidable coupling section 424 of the slide seat 42. The base wall 421 and the lateral walls 422 cooperate to form a channel 425 having an upward opening for the guide 222 to extend slidably through the slide seat 42. The first attachment member 32 is disposed above the guide 222 and is fixedly connected to the top edges of the lateral walls 422. The containing section 426 is formed with a containing space 427 containing the gear set 43 and through which the fixed threaded rod 41 extends. The slide seat 42 may be formed using a pair of coupled housings and is not described in further detail.

The gear set 43 is retained in the containing space 427, and includes a first gear 431 formed with an axial threaded hole through which the fixed threaded rod 41 extends threadedly. The gear set 43 further includes a second gear 432 coupled to the drive part 45 and meshing with the first gear 431. The first gear 431 and the second gear 432 may each be a bevel gear.

The gear set 43 also includes a threaded cylinder 433 connected integrally with the first gear 431 and engaged threadedly with the fixed threaded rod 41. The threaded cylinder 433 extends axially away from one end of the first gear 431. The bearings 44 are mounted between the threaded cylinder 433 and the slide seat 42 such that the threaded cylinder 433 and the connected first gear 431 are co-rotatable relative to the slide seat 42.

The drive part 45 includes a crank arm 451 disposed at the outer side of the slide seat 42 and connected to the gear set 43 for driving rotation of the gear set 43 when the crank arm 451 is rotated. The crank arm 451 may be mounted rotatably to the slide seat 42. The drive part 45 further includes a grip 452 formed at a tail end of the crank arm 451 for a user's hand to hold, and a connecting section 453 that is formed at a head end of the crank arm 451 and that extends into the containing section 426. In this embodiment, the second gear 432 is integrally formed on the connecting section 453. In variations of the preferred embodiment, the drive part and the second gear 432 may be independently manufactured and fixed together by screws or any other type of fastening mechanism, and are therefore not limited to the disclosed embodiment.

To adjust the tightness of the cable 31, the drive part 45 is rotated, which drives rotation of the second gear 432. The second gear 432 in turn meshes with and drives a corresponding rotation of the first gear 431. Rotation of the first gear 431 relative to the fixed threaded rod 41 drives linear movement of the slide seat 42 relative to the fixed threaded rod 41, enabling the cable 31 to be loosened or tightened.

Use of the control unit 4 to adjust the cable tension in the preferred embodiment of the present invention may provide multiple benefits.

Improved quality is provided. The fixed threaded rod 41 is fixedly mounted to the first mounting structure 22, and the slide seat 42 is movably mounted on the fixed threaded rod 41. The gear set 43, the bearings 44, and the drive part 45 move together with the slide seat 42 along the fixed threaded rod 41. The control unit 4 is therefore designed to include movable components. Accordingly, the present embodiment provides improved tolerance of alignment differences between the first mounting structure 22 and the fixed threaded rod 41. Manufacturing and assembly costs are thus lowered, and product quality is improved.

Improved safety is provided. The front and rear end portions 411, 412 of the fixed threaded rod 41 are fixed to the front block 223 and the rear block 224, respectively. Given that the fixed threaded rod 41 does not move, the reliability of the fixed threaded rod 41 and the first mounting structure 22 are improved. In addition, the fixed threaded rod 41 does not extend through the front block 223, allowing the front block 223 to both position and abut against the fixed threaded rod 41 to provide a blocking function. The fixed threaded rod 41 is thus prevented from moving in response to a force applied to the slide seat 42. In addition, the cable unit 3 is fixedly mounted between the two lateral sides of the support unit 2. Improved safety is therefore provided for a user of the adjustable tree stand, according to the preferred embodiment of the present invention.

Improved part retention is provided. Given that the drive part 45 is fixed to or integrally formed with the second gear 432, and that one or both parts are mounted to the slide seat 42, components of the adjustable tree stand according to the preferred embodiment will not be lost during transport.

In summary, the present invention facilitates manufacturing, safety, and component retention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An adjustable tree stand, comprising:

a support unit that includes a support platform having two lateral parts, and that further includes first and second mounting structures, each mounted to a corresponding one of said lateral parts of said support platform;

a cable unit that includes a cable, a first attachment member connected to one end of said cable, and a second attachment member connected to the other end of said cable for releasably coupling with said second mounting structure; and a control unit including a threaded rod mounted non-rotatably to said first mounting structure, a slide seat connected to said first attachment member of said cable unit and coupled movably to said first mounting structure for sliding movement therealong, a gear set mounted rotatably to said slide seat and threadedly engaging said threaded rod, and a drive part for driving rotation of said gear set to thereby cause said slide seat to move along said first mounting structure for adjusting a tension of said cable unit wherein said gear set includes a first gear formed with an axial threaded hole through which said threaded rod extends threadedly, and a second gear coupled to said drive part and meshing with said first gear, rotation of said second gear due to driving by said drive part resulting in rotation of said first gear relative to said threaded rod and movement of said slide seat along said first mounting structure, wherein said gear set includes a threaded cylinder connected integrally with said first gear and engaging threadedly said threaded rod, said control unit including a bearing installed between said threaded cylinder and said slide seat such that said threaded cylinder and said first gear are co-rotatable relative to said slide seat and that said gear set, said bearing, and said drive part are movable together with said slide seat along said threaded rod, and wherein said first mounting structure includes a strut that extends upward from a forward section of the corresponding one of said lateral parts, a guide that extends rearward from a top part of said strut, a front block mounted to said strut and formed with a blind hole that opens rearward, and a rear block fixed to a rearward part of said guide, said threaded rod including a front end portion fixed in said blind hole, and a rear end portion fixed to said rear block.

2. The adjustable tree stand as claimed in claim 1, wherein said drive part includes a crank arm mounted rotatably to said slide seat and connected to said gear set for driving rotation of said gear set when said crank arm is rotated.

3. The adjustable tree stand as claimed in claim 1, wherein each of said first gear and said second gear is a bevel gear.

4. The adjustable tree stand as claimed in claim 1, wherein said threaded cylinder extends away from said first gear.

5. The adjustable tree stand as claimed in claim 1, wherein said second gear is connected integrally to said drive part.

6. The adjustable tree stand as claimed in claim 1, wherein said guide is substantially parallel to said threaded rod, said slide seat including a slidable coupling section having a pair of lateral walls and a base wall disposed between said lateral walls, said base wall and said lateral walls cooperating to form a channel for said guide to extend slidably through said slide seat, said first attachment member being connected to said lateral walls, and said slide seat further including a containing section that is connected to said slidable coupling section, said containing section forming a containing space containing said gear set and through which said threaded rod extends.

* * * * *